US005085171A

United States Patent [19]

Aulick et al.

[11] Patent Number: 5,085,171

[45] Date of Patent: Feb. 4, 1992

[54] COMPLIANT DOCTOR BLADE

[75] Inventors: Larry O. Aulick, Cynthiana; Donald W. Stafford; Ajay K. Suthar, both of Lexington, Ky.

[73] Assignee: Lexmark International, Inc., Greenwich, Conn.

[21] Appl. No.: 712,382

[22] Filed: Jun. 10, 1991

[51] Int. Cl.[5] ..... G03G 15/08

[52] U.S. Cl. ..... 118/653; 118/657; 118/261; 355/259

[58] Field of Search ..... 118/661, 261, 657, 658, 118/656, 653; 355/251, 253, 255, 259

[56] References Cited

U.S. PATENT DOCUMENTS 4,538,898 9/1985 Kanno et al. .
4,553,829 11/1985 Bares ..... 118/657 X
4,583,490 4/1986 Kan et al. ..... 118/658
4,596,455 6/1986 Kohyama et al. ..... 118/656 X
4,616,918 10/1986 Kohyama et al. ..... 118/656 X
4,637,706 1/1987 Hosoi et al. .
4,835,565 5/1989 Nagatsuna et al. ..... 355/259
4,851,872 7/1989 Murasaki et al. ..... 355/253
4,895,105 1/1990 Kubo et al. ..... 355/251 X

OTHER PUBLICATIONS

IBM Technical Disclosure Bulletin, article entitled "Doctor Blade Design for Monocomponent Nonmagnetic Developer," vol. 33, No. 5, Oct. 1990 at pp. 14–15.

*Primary Examiner*—R. L. Moses
*Attorney, Agent, or Firm*—John A. Brady

[57] ABSTRACT

A doctor blade (1) has an outer metal surface (15) on a grit layer with flexible backing. The blade is pushed by foam (21) or, alternately by inherent resilience, onto a developer roller (7). The compliance reduces toner variations which result from surface variations of the blade and the roller.

18 Claims, 1 Drawing Sheet

FIG. 1
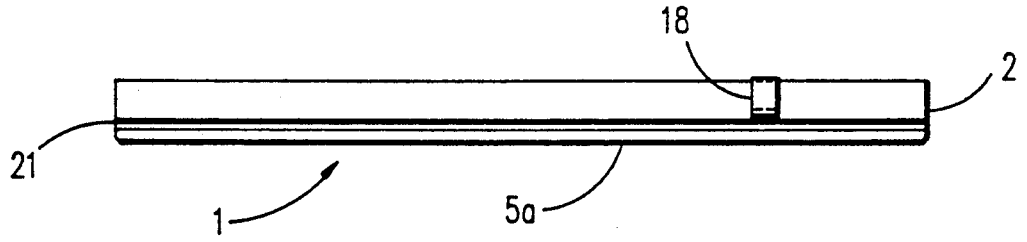
FIG. 2A
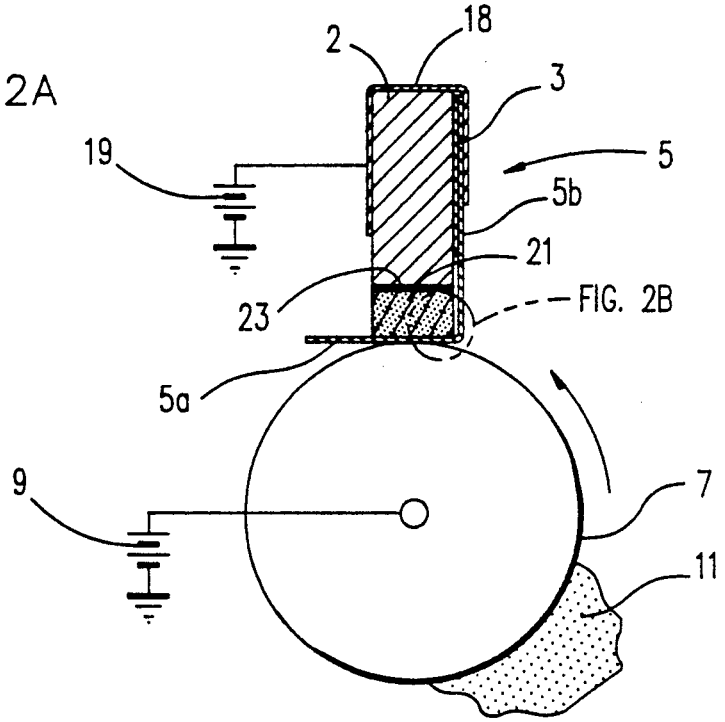
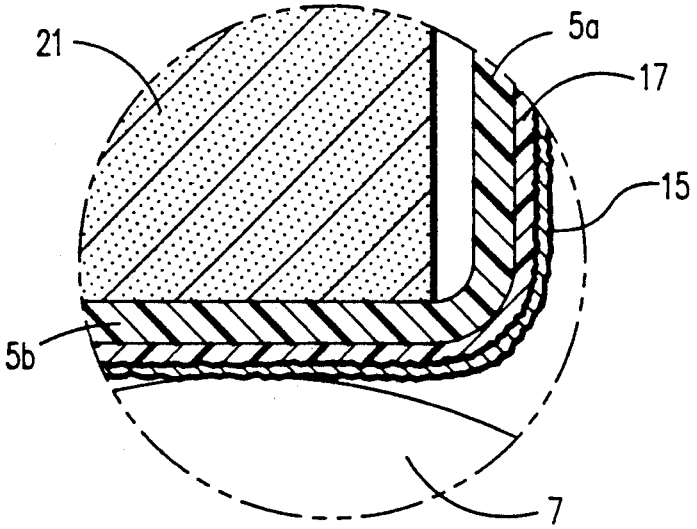
FIG. 2B

COMPLIANT DOCTOR BLADE

DESCRIPTION

1. Technical Field

This invention relates to electrophotographic development and, more particularly, relates to a doctor blade operative on a roller, known as a developer roller, on the surface of which toner is transferred to a photoconductive surface carrying a latent image to be developed by the toner.

2. Background of the Invention

A prior art laser printer sold commercially as the IBM LaserPrinter employs electrophotography in which toner is charged and brought into contact with the surface of a rotating developer roller which carries metered toner into a nip contact with a photoconductor in the form of a drum having a photoconductive surface. The developer roller is semiconductive and charged to a potential between that on the toner and that on charged areas of the photoconductor. As the developer roller rotates, toner is attracted to the developer roller surface from a supply source of toner.

When the developer roller surface has left contact with the toner supply and is rotating toward a nip contact with the photoconductor surface, it encounters a doctor blade which is in direct contact with the developer roller surface and which is charged to a potential of the same polarity as desired for toner passing under the doctor blade. The action of the doctor blade limits toner to a controlled, thin layer on the developer roller. This doctor blade in combination with the developer roller is the subject of the article entitled "Doctor Blade Design For Monocomponent Nonmagnetic Developer," in the *IBM Technical Disclosure Bulletin* Vol. 33, No. 5, October 1990 at pp. 14–15. That blade is slightly roughened on the surface contacting the developer roll. Toner brought to the blade is believed to have a significant portion charged in the opposite polarity to that intended for development. The interaction of the blade charged to the intended polarity and the mechanical effects at the contact between the blade and the developer roller result in the toner passing the blade to be highly predominant in the intended charge.

The prior doctor blade is rigid and therefore could permit the toner layer to vary with surface variations in the doctor blade itself and the developer roller it comes in contact with. Such variations in the toner layer result in corresponding variations in the visible image made by the toner, both print and graphics. This invention provides a compliant doctor blade which ideally eliminates such variations. No such doctor blade is known to be prior to this invention.

DISCLOSURE OF THE INVENTION

The doctor blade for metering toner in accordance with this invention comprises a doctoring surface having a metal layer over an irregular surface, such as particulate grit, on a flexible backing layer. The flexible backing layer is pushed by a resilient structure, which may be foam. Alternatively, the flexible support layer may be resilient itself, such a spring steel. A rigid bar supports this assembly, with the flexible backing layer bent back under that support bar. The outer side of the irregular surface is metal-plated for connection to the an electrical potential source.

This doctor blade surface is compliant, textured, wear-resistant, and conductive. It does not require an expensive tungsten carbide coating as the doctoring surface, which is used on the previous, rigid blade.

BRIEF DESCRIPTION OF THE DRAWING

The details of this invention will be described in connection with the accompanying drawing, in which FIG. 1 is a view from the rear of the doctor blade, FIG. 2A is an enlarged side view of the doctor blade and the developer roller in operation, and FIG. 2B is a further enlargement of part of FIG. 2A.

BEST MODE FOR CARRYING OUT THE INVENTION

The doctor blade of the foregoing commercial laser printer is made from a steel bar with a tungsten carbide coating. Such a coating with its required precision in dimension is relatively costly to achieve. Because of its rigidity, the pressure of that blade against the developer roller varies along the length of the blade, resulting in variations in the metering of toner by the doctor blade.

As shown in FIG. 1 doctor blade 1 comprises a support bar 2 of aluminum, specifically a 3.8 mm by 10 mm aluminum 1100 stock bar 231.5 mm in length. Extending throughout the length of bar 2 a laminate 5 (FIG. 2A) having 3 mil (about 0.00761 cm) thick backing of polyethylene terephthalate polyester (trademarked as Mylar) carrying silicon carbide particles of 5 to 9 micron in diameter is held by adhesive 3. Specifically, adhesive 3 is a commercial dual side tape of 1 mil (about 0.00254 cm) thick polyester having adhesive on both sides, with total thickness of 0.13 mm, width of 8.5 mm, and length of coextensive with the length of bar 2. Preferably, laminate 5 with particles may be a commercial sandpaper sold as Imperial Lapping Film, with the particle size being a specific one between 5 and 9 micron in diameter.

Laminate 5 is naturally straight, but is flexible and is bent 90 degrees so as to have a lower portion 5*a* and a higher portion 5*b*, the higher portion 5*b* being bonded by the adhesive 3. (Alternatively, adhesive 3 may be replaced by, for example, clips or rivets.)

Developer roller 7 comprises a semiconductive, organic elastomer charged to a predetermined potential by a fixed potential source 9. As in the prior laser printer, roller 7 is contacted with a supply of charged toner 11 in the lower-right area of FIG. 1 as developer roller 7 rotates counterclockwise. The toner is normally primarily charged to a polarity the same as the polarity of roller 7 while having a significant amount of toner charged to the opposite polarity. The sector of developer roller 7 encountering doctor blade 1 carries such toner, and the toner of opposite polarity is blocked by the charged doctor blade 1 so that only a thin layer of toner 11 passes doctor blade 1 and that thin layer is charged in great predominance to the correct polarity.

As shown in FIG. 2B, the outer surface of laminate 5 of blade 1 is a thin layer of aluminum 15 vapor deposited of thickness of 1200 angstrom and with measured resistively between 0.05 and 0.20 ohm/square. The vapor deposition may be by any standard process. Aluminum layer 15 is plated on abrasive layer 17, which is a mixture of silicon carbide particles and a phenolic resin binder coated and hardened on laminate 5. Preferably, the foregoing commercial lapping film is vapor deposited on all of one side to form laminate 5.

A narrow (preferably 8 mm wide) conductive band 18 spans bar 2. Band 18 is preferably an 18 mm long section of commercially available copper grounding tape, which has a conductive adhesive side which is attached to the laminate 5 across the top of bar 2 and to the side of bar 2 opposite laminate 5. Band 18 provides an electrical contact between the metalized laminate 5 and bar 2. Aluminum layer 15 is charged in the same polarity as roller 7 by a fixed potential source 19 which contacts the back of band 18.

In use laminate 5 having outer layer 15 integral with it is simply bent back at a position contiguous to developer roller 7. As shown in FIG. 2, a continuous body of foam 21 is located between support bar 2 and laminate 5 which is compressed to provide a light force pushing laminate 5 into roller 7. Preferably foam 21 is a commercially available polyurethane foam of 20 lbs./ft. squared. Foam 21 is held in place by a double side adhesive side tape 23 4 mm in width and 0.13 thick. Various alternatives to foam 21 may be readily employed, and foam 21 may be eliminated by using naturally straight steel or copper as thin as about 0.00254 cm as the support layer not requiring foam. When bent back as described, the inherent resilience of the metal provides the force toward roller 7.

In use, it is possible that aluminum 15 may wear away quickly at the peaks, but this does not impair operability, since aluminum remains on the lower regions. Excellent compliance is experienced with corresponding consistency in final toner images. No significant wear is experienced on the body of the thin aluminum layer 15 in as much as 18,000 standard ($8\frac{1}{2} \times 11$ inch) printed pages. Since, in its preferred form, this invention is contained in a supply cartridge which is replaced when toner is exhausted, exceptionally long life of the doctor blade 1 is not essential.

Variations in the form and in the materials used are readily visualized and would be within the spirit and scope of this invention. Coverage is sought corresponding as provided by law.

We claim:

1. An electrically energized doctor blade for metering charged electrophotographic toner held on a developer roller by physically contacting a sector of said roller with a surface of said blade which is electrically charged, said blade comprising a compliant backing member, a supporting member to position said blade adjacent to said roller, a layer having an irregular surface bound to said backing member on a surface of said backing member facing said roller, and a metal layer on at least the lower regions of the irregular surface of said surface facing said roller.

2. The doctor blade as in claim 1 in which said irregular surface is formed by particulate grit.

3. The doctor blade as in claim 2 in which said grit is of diameter of about 5 microns to 9 microns.

4. The doctor blade as in claim 3 in which said backing member is naturally straight metal having inherent resilience when bent.

5. The doctor blade as in claim 1 in which said backing member is naturally straight metal having inherent resilience when bent.

6. The doctor blade as in claim 2 in which said backing member is naturally straight metal having inherent resilience when bent.

7. The doctor blade as in claim 1 in which said backing member is a polymer film and also comprising a resilient member mounted on said supporting member to provide a force toward said roller.

8. The doctor blade as in claim 2 in which said backing member is a polymer film and also comprising a resilient member mounted on said supporting member to provide a force toward said roller.

9. The doctor blade as in claim 3 in which said backing member is a polymer film and also comprising a resilient member mounted on said supporting member to provide a force toward said roller.

10. A doctor blade and a developer roller mounted for metering charged electrophotographic toner held on said developer roller by said blade physically contacting a sector of said roller with a surface of said blade which is electrically charged, said blade comprising a compliant backing member, a supporting member positioning said blade in contact with said roller, a layer having an irregular surface bound to said backing member on a surface of said backing member facing said roller, and a metal layer on at least the lower regions of the irregular surface of said surface facing said roller.

11. The doctor blade and developer roller as in claim 10 in which said irregular surface is formed by particulate grit.

12. The doctor blade and developer roller as in claim 11 in which said grit is of diameter of about 5 microns to 9 microns.

13. The doctor blade and developer roller as in claim 12 in which said backing member is naturally straight metal having inherent resilience when bent.

14. The doctor blade and developer roller as in claim 10 in which said backing member is naturally straight metal having inherent resilience when bent.

15. The doctor blade and developer roller as in claim 11 in which said backing member is naturally straight metal having inherent resilience when bent.

16. The doctor blade and developer roller as in claim 10 in which said backing member is a polymer film and also comprising a resilient member mounted on said supporting member to provide a force toward said roller.

17. The doctor blade and developer roller as in claim 11 in which said backing member is a polymer film and also comprising a resilient member mounted on said supporting member to provide a force toward said roller.

18. The doctor blade and developer roller as in claim 12 in which said backing member is a polymer film and also comprising a resilient member mounted on said supporting member to provide a force toward said roller.

* * * * *